United States Patent [19]

Smith

[11] Patent Number: 4,582,735

[45] Date of Patent: Apr. 15, 1986

[54] IMPREGNATED FIBROUS LAMINATES

[75] Inventor: Garrett N. Smith, Hartsville, S.C.

[73] Assignee: Sonoco Products Company, Hartsville, S.C.

[21] Appl. No.: 632,368

[22] Filed: Jul. 19, 1984

[51] Int. Cl.[4] ..... B32B 27/00

[52] U.S. Cl. ..... 428/36; 428/425.1; 428/537.5

[58] Field of Search ..... 428/425.1, 36, 537.5

[56] References Cited

U.S. PATENT DOCUMENTS 3,930,110 12/1975 Shoemaker et al. ..... 428/425.1
3,996,154 12/1976 Johnson et al. ..... 521/49
4,505,778 3/1985 Robertson ..... 162/135

FOREIGN PATENT DOCUMENTS 2331293 6/1973 Fed. Rep. of Germany ... 428/425.1

*Primary Examiner*—Edith Buffalow
*Attorney, Agent, or Firm*—Dennison, Meserole, Pollack & Scheiner

[57] ABSTRACT

An improved fibrous laminate is formed by impregnating a paper-like material with a substantially anhydrous emulsifiable methylene diisocyanate (EMDI) and allowing the EMDI to cure at ambient or higher temperature. EMDI-impregnated laminates, such as tubes and cones show improved strength compared with prior art products and are especially resistant to water.

8 Claims, 5 Drawing Figures

36" BEAM-2.7" I D

AXIAL CRUSH - 2.7" I D

4" FLAT CRUSH
2.7" I D

RADIAL CRUSH
2.7" ID

TUBE DENSITY
2.7" ID

IMPREGNATED FIBROUS LAMINATES

This invention relates to laminates of paper-like materials impregnated with a synthetic resinous material. More particularly, the invention relates to the strengthening of paper tubes and cones with a synthetic resinous material.

Tubes and cones made from fibrous paper-like materials such as paperboard are generally formed by spirally or convolutely winding a plurality of strips of paper in overlying relationship with adhesive therebetween to form a multi-ply paper tube or cone.

Tubes and cones may be formed in this manner from untreated paper. Untreated paper is flexible and repulpable, but tubes formed of untreated paper lack strength and water resistance. In order to increase the strength and resistance to moisture of such paper tubes and cones as well as to form a relatively hard outer surface on these tubes and cones, the articles may be impregnated with a suitable impregnant such as a synthetic resinous material. The impregnation may be carried out by immersing the finished tube or cone in a bath of impregnating material or by forming the tube or cone from a previously impregnated fibrous material.

The impregnant frequently used is a phenol-formaldehyde resin. These phenol-formaldehyde resins present problems in processing since they cure only with extended times at elevated temperatures, e.g. by steam-chesting and must be at least partially cured immediately after impregnation so the paper can be stored without blocking. Even partially cured resin impregnated paper tends to block when rolled upon itself, although it can be unrolled with some effort. Moreover, while the impregnated paper is stronger and more water resistant than untreated paper, it also has low internal flexibility, tending to be brittle. Thus, phenolic tubes may shatter under deformation. These difficulties result in high costs associated with the use of phenol-formaldehyde impregnant. Phenol-formaldehyde impregnation is a capital and energy intensive process, which results in high costs, while yielding a product which leaves much to be desired.

The difficulties and costs associated with phenol-formaldehyde impregnated tubes suggest limited application for treated tubes. Untreated tubes, however, often possess inadequate strength for many applications. It would be desirous to have a treatment that would provide both strength and flexibility in order to withstand sudden impacts or abrasions which could lead to shattering of phenol-formaldehyde impregnated tubes and crushing of weaker, untreated tubes.

SUMMARY OF THE INVENTION

It is accordingly an object of the present invention to provide a paper tube or cone having improved strength and increased resistance to abrasion and water penetration.

It is another object of the present invention to produce an impregnated paper for tubes and cones to be rotated at a high rate of speed, and subjected to physical abuse.

It is another object of the present invention to provide an impregnated paper tube or cone having a low cost.

It is still a further object of the present invention to provide a method for impregnation of paper which provides savings of capital, energy and time as compared to the prior art.

These and other objects of the present invention can be achieved by the impregnation of paper-like materials with a substantially anhydrous emulsifiable methylene diisocyanate (EMDI). It has been found that EMDI will rapidly and completely penetrate fibrous materials, will cure quickly even at ambient temperature, without blocking, and will provide a paper with excellent strength, flexibility, and abrasion resistance at lower total cost than prior art materials.

Thus, the present invention includes impregnated fibrous tubes and cones formed by impregnating a paper-like material with substantially anhydrous EMDI, allowing the EMDI to cure to a required hardness, and before, during or after the curing step, coating at least one ply of impregnated material with adhesive and winding together a plurality of plies of impregnated material to form a laminate tube or cone. The invention also includes tubes and cones formed by EMDI-impregnation of previously formed laminate tubes and cones, and extends to laminates comprising a plurality of EMDI-impregnated layers of paper-like material.

DETAILED DESCRIPTION OF THE INVENTION

Figure 1:
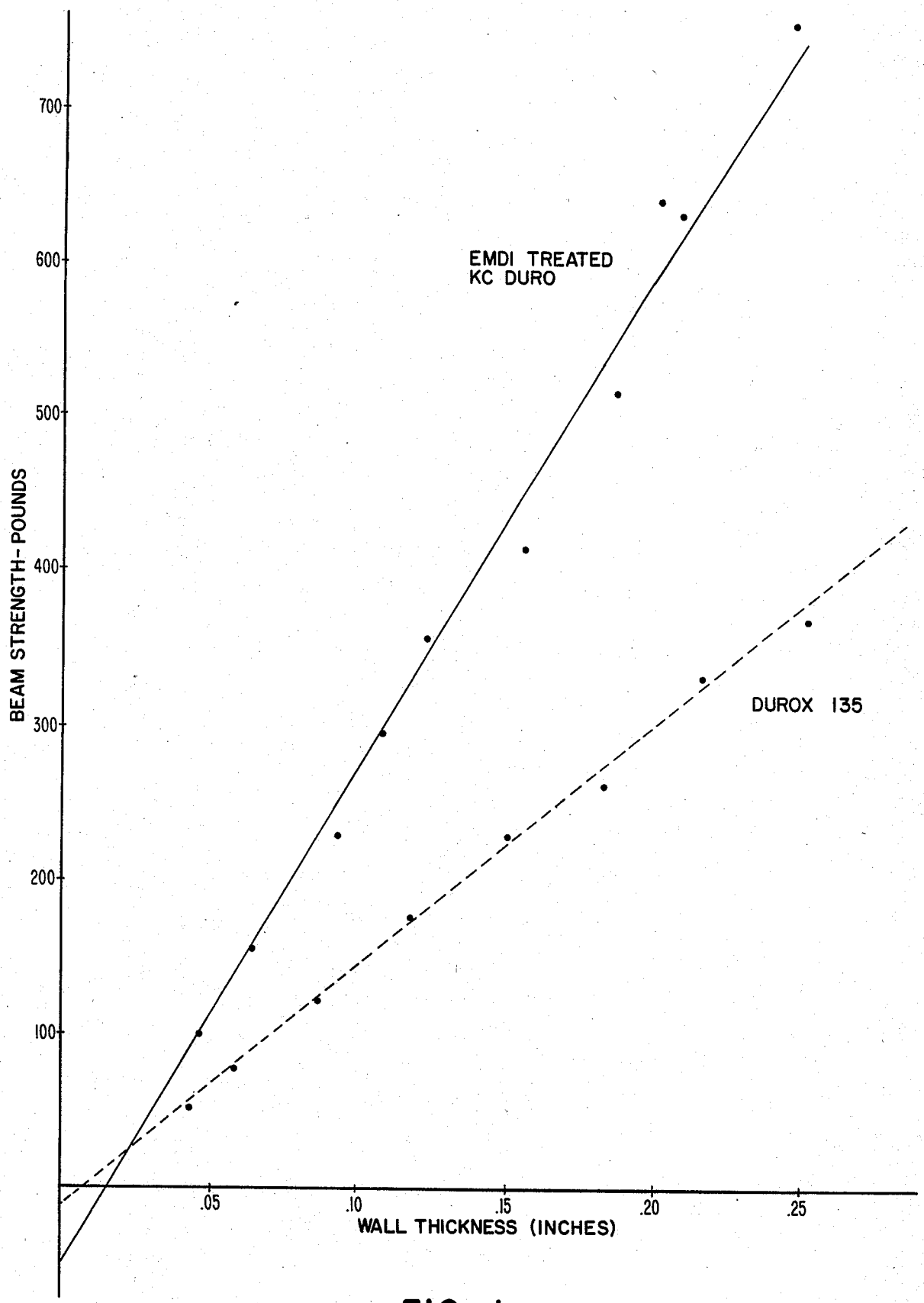
FIG. 1 is a graph of beam strength vs. wall thickness for tubes of EMDI-treated paper and untreated high strength paperboard.

The impregnant of the present invention is known as emulsifiable methylene diisocyanate (EMDI). This term refers to mixtures of materials which are discussed in detail in U.S. Pat. No. 3,996,154 to Johnson et al, which is hereby incorporated by reference, comprising aromatic diisocyanate and/or polyisocyanates of higher functionality having a methylene bridge. Methylene bridged polyphenyl polyisocyanates are well known in the art and have the formula:

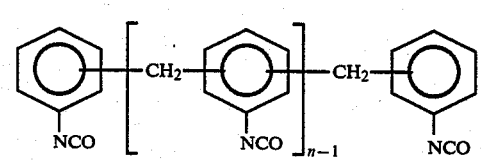

where n is one or more. EMDI formulations also include a nonionic surface active agent devoid of hydroxy, amino or carboxylic acid groups and which may include condensates of alkyl phenols, long chain alcohols and amides with ethylene oxide, the end hydroxy group, for example, being etherified or esterified. Of particular value as surface active agents in this application are the reaction products of diisocyanates and higher functionality polyisocyanates with monoalkyl ethers of polyethylene glycols. These particular surface active agents or emulsifying agents have the formula $RO(CH_2CH_2O)_nCONHX$ where R is an alkyl group of from 1 to 4 carbon atoms, and is an integer such that the compound contains an average of at least 5 oxyethylene groups and X is the residue of a di or polyisocyanate and contains at least one free isocyanate group. There must be sufficient oxyethylene groups ($CH_2CH_2O$) present in the surface active agent that there is an average of 5 such groups per molecule. It is preferred that n represent an average of from 5 to 120. The EMDI preferably contains 5 to 15 parts by weight of surface active agent per 100 parts by weight of isocyanate.

EMDI dispersions in water are useful as adhesives, binders, and surface coatings. They have been used as binders for particleboard and chipboard, adhesives for polyurethane foam, leather and wood, and weatherproofing coatings for wood and concrete.

The preferred EMDI impregnant of the present invention is sold under the name Rubinate MF-178 by Rubicon Chemicals, Inc. of Wilmington, Del. This material is understood to comprise approximately 50% diphenylmethane-4,4'-diisocyanate, approximately 45% higher methylene-bridged isocyanate polymers and approximately 5% surfactant in the form of modified diphenylmethane diisocyanate. This material is supplied as a liquid containing approximately 95% solids.

The impregnation process of the present invention is applicable to a wide variety of coated and uncoated papers, paperboards such as those generally used in box-making, recycled papers, and other fibrous, flexible materials, including those containing both cellulosic and polymeric fibers. The term "paper-like materials" is used herein as a general term to refer to such materials.

According to the present invention, impregnation of the paper may take place by simple immersion in substantially anhydrous EMDI. Saturation of the paper with the EMDI has been found to be almost instantaneous, with a 10 second saturation time on an uncoated 15 point kraft resulting in 88% take-up. Because take-ups this high are uneconomical, it may be advisable to impregnate materials which are traditionally non-impregnable in order to reduce the take-up level. For example, impregnation of a 15 point kraft coated paperboard will result in about 18% take-up of EMDI, but will provide a paperboard of excellent strength.

The impregnated paper-like material may then be treated in any of a number of ways. For example, if no further processing is desired at the time of impregnation, the paperboard may be rolled around a core and allowed to cure at ambient temperature and humidity. It has been found that the EMDI impregnated paper generally will not block, although blocking in specific areas may occur due to impurities in the paper, such as hot melt adhesives sometimes found as contaminants in recycled paper. When further processing is desired, the paperboard may be unwound, coated with adhesive, and wound together with further impregnated or unimpregnated paperboard plies to form a laminate tube or cone of desired thickness. While it is possible to form a multi-ply tube or cone by winding one adhesive-coated ply upon itself, a number of separate plies will normally be wound together.

While not wishing to be bound by any particular theory, it is thought that the EMDI is reactive primarily with the water moisture in the paper to form a substituted urea, and with the primary and secondary hydroxyl groups in the paper to form a urethane cellulose. The formation of the substituted urea is thought to interfere with the tendency of the paper layers to bond together. There may also be an effect from the presence of the emulsifier in the EMDI.

The time necessary for the EMDI to completely react with the paper will depend on temperature and relative humidity. At 73° F. and 50% R.H., the EMDI reaction with **421*b*** linerboard will be 50% complete in 48 hours, and 100% complete in 12–14days. This is thought to result from an initial, rapid reaction with water in the paper, followed by a slower reaction with the paper itself. At 250° F., the reaction is complete in a matter of seconds.

The paperboard may also be adhered and formed into a tube or cone at the time of impregnation. Since the take-up of the EMDI is almost instantaneous, the adhesive may be applied directly after impregnation, and multiple layers wound together to form a laminate tube or cone of desired thickness. The formed tube or cone may then be cured either at ambient temperature and humidity or under the presence of heat, either direct or frictional.

It will be understood that in forming the laminate tube or cone, every layer need not be an EMDI-impregnated layer. Further, every layer need not be adhesive-coated, as long as the uncoated surfaces are in contact with adhesive-coated surfaces.

It is also possible to form the tube or cone initially, and post-treat the tube or cone with EMDI to provide a product that exhibits specific abuse resistance, water barrier properties or strength. It is possible, for example, to post-treat only certain areas, such as the ends of the tube. The treated tube or cone may then be cured either at ambient temperature and humidity or under direct or frictional heat.

A problem has arisen in terms of finding an adhesive that will adequately bond layers of EMDI impregnated paper board which have been cured. Curing of the impregnated paperboard alters the physical characteristics of the surface which relate to adhesion, particularly penetration of adhesive into the surface, and since the cured product has many of the same properties as does plastic, bonding layers of the treated paperboard is similar to bonding two pieces of plastic. Many adhesives result in spotty adhesion in such applications. One particular adhesive known commercially as Haloflex ®208 has provided better results than others. This adhesive is a blend of polyvinyl chloride, polyvinylidene chloride, and acrylates, and is sold by ICI Americas, Wilmington, Del. Another solution to the adhesion problem is to coat the paper with adhesive after impregnation but prior to curing of the EMDI. This method is possible because the EMDI is absorbed rapidly enough into the body of the paper to allow surface spreading of the adhesive. Utilizing this method, the excess EMDI is scraped off following impregnation and a conventional adhesive is then coated onto the paper. Following application of the adhesive, several layers of paperboard are adhered together prior to curing.

Further aspects of the present invention may be seen from the following examples. The tests referred to are TAPPI standards as follows:

A. Caliper of paper and paperboard T411
B. Basis weight and coating of paper T410
C. Ring crush of paperboard T818

D. Tensile breaking properties of paper and paperboard T494
E. Stiffness of paperboard T489
F. Bending number of paperboard T495
G. Tearing resistance of paperboard, edge T470
H. Mullen test for bursting strength T403,T807,T810
I. Tensile breaking strength of paper and paperboard (wet) T456
J. Water absorbency, paperboard (non bibulous) T492
K. Moisture in paper T412

EXAMPLE 1

0.015" kraft coated Duro® was completely impregnated with Rubinate MF-178 by immersion. The treating line was run at about 50 belt feet per minute to achieve complete saturation, with an immersion time of about 10 seconds. The web was then rolled up and allowed to cure at room temperature for several days before samples were removed for physical analysis. After a suitable cure was achieved, the rolls were rewound and slit. It was observed that there was no sticking together of the paper plies. The properties of the cured impregnated paper were then compared with the properties of untreated kraft coated Duro®, with Durox®135, a high strength untreated paperboard, and with 15 point saturating kraft treated with phenol-formaldehyde resin, and baked at 325° F. for 1 hour. The results of this testing are seen in Table 1:

TABLE 1

| | Physical Test | EMDI Treated Kraft Coated DURO ® | Untreated Kraft Coated DURO ® | Untreated DUROX ® 135 | Phenolic Treated 15 point Saturating Kraft |
|---|---|---|---|---|---|
| | % Take up | 16.22 | NA | NA | 100% |
| A. | Caliper, mils | 16.80 | 16.80 | 16.22 | 15.90 |
| B. | Basis Wt., Lbs/MSF | 76.40 | 62.60 | 64.70 | 62.46 |
| C. | Ring Crush, Lbs. | | | | |
| | Machine Direction | 386 | 166 | 263 | 406 |
| | Cross Direction | 295 | 115 | 150 | 363 |
| | Ring Crush, psi | | | | |
| | Machine Direction | 3827 | 1644 | 2700 | 4283 |
| | Cross Direction | 2922 | 1141 | 1535 | 3829 |
| D. | Tensile, Lbs. | | | | |
| | Machine Direction | 181 | 119 | 151 | 152.5 |
| | Cross Direction | — | 28 | 32 | — |
| | Tensile, psi | | | | |
| | Machine Direction | 10,748 | 7095 | 9303 | 9652 |
| | Cross Direction | — | 1655 | 1985 | — |
| E. | Stiffness, gcm | | | | |
| | Machine Direction | 235 | 194 | 193 | 183 |
| | Cross Direction | 95 | 45 | 43 | 128 |
| F. | Bending Modulus, psi | | | | |
| | Machine Direction | 860,806 | 712,500 | 785,714 | 870,000 |
| | Cross Direction | 347,985 | 165,441 | 173,469 | 547,000 |
| G. | Tear, g | | | | |
| | Machine Direction | 202 | 238 | 259 | — |
| | Cross Direction | 328 | 390 | 458 | — |
| H. | Mullen, Lbs. | 147 | 124 | 151 | — |
| I. | Wet Tensile, Lbs. Machine Direction | 64 | 5.3 | 7.8 | — |
| | Wet Tensile, psi Machine Direction | 3825 | 315 | 2.4 | — |
| J. | Water Drop, Min. | 15+ | 6.3 | 2.6 | — |
| K. | Moisture, % | 6.5 | 8.2 | 8.2 | — |

From Table 1, it can be seen that the kraft coated Duro® with 16% EMDI take-up increased the MD ring crush of the paper by 133%. The treated paperboard also has a 47% higher MD ring crush than the Durox®135. In addition, the treated paperboard retained 36.0% of its dry tensile strength after prolonged immersion in water, whereas the untreated Duro® retained only 4.4% of its dry tensile strength, and the Durox®135 retained only a small fraction of is dry tensile strength.

By comparison of the bending moduli in Table 1, it can be seen that the flexibility of the EMDI treated paper is not greatly different from the flexibility of the untreated paper. There is, however, a greater tendency of the treated paper to tear.

It has also been found that the EMDI-treatment of the paper increases its basis weight about 22% without affecting it caliper, increases its resistance to water and lowers its overall moisture content. The phenolic-treated paper had similar properties to the EMDI-treated paper. However, tubes formed from phenolic-treated paper tend to shatter under deformation, whereas EMDI-treated tubes do not. For this reason, phenolic-treated paper is not tested in the following examples.

EXAMPLE 2

A series of two-ply laminates were formed from the EMDI treated papers of Example 1 in order to obtain information about the strength of laminates produced by various adhesives. As comparisons, two-ply laminates were also formed with two layers of Durox®135 and with one layer of Durox®135 and one layer of EMDI-treated paperboard according to Example 1.

The process of adhering layers of paper into a spiral composition can affect overall tube strength, which is a function of type of adhesive and type of paper. MD crush strength is a simple test which predicts tube strength. In this test, the force necessary to crush two ply paper laminates edgewise is measured.

Table 2 gives the results of MD ring crush tests for the laminates, as well as stiffness, bending modulus, and tensile strength tests.

TABLE 2

| Adhesive | Construction | MD Stiffness gcm | MD Ring Crush psi | Bending Modulus psi | MD Tensile lbs. | MD Tensile psi |
|---|---|---|---|---|---|---|
| Haloflex ® 208 ICI Americas | Treated KC DURO ®/ Treated KC DURO ® | 1,125 | 4,319 | 538,278 | 183 | 11,037 |
| Polyvinyl Chloride-Polyvinylidene Chloride-Acrylates | Treated KC DURO ®/ DUROX ® 135 | 1,185 | 3,400 | 609,255 | 150 | 9,463 |
| | DUROX ® 135/ DUROX ® 135 | 600 | 2,389 | 325,028 | 25 | 1,638 |
| E-200 Nat. Adhesives | Treated KC DURO ®/ Treated KC DURO ® | 1,395 | 3,635 | 682,485 | 191 | 11,541 |
| Ethylene-vinyl Acetate | Treated KC DURO ®/ DUROX ® 135 | 1,080 | 2,912 | 551,020 | 134 | 8,221 |
| | DUROX ® 135/ DUROX ® 135 | 990 | 2,771 | 604,027 | 64 | 4,032 |
| CHM-6262 Sonoco | Treated KC DURO ®/ Treated KC DURO ® | 1,300 | 3,684 | 625,602 | 182 | 11,318 |
| Ethylene-vinyl Acetate | Treated KC DURO ®/ DUROX ® 135 | 1,050 | 2,787 | 523,169 | 90 | 5,531 |
| | DUROX ® 135/ DUROX ® 135 | 870 | 1,988 | 500,864 | 64 | 4,032 |

For any given adhesive, laminates made from EMDI-treated kraft coated Duro® exhibited high MD ring crush without an appreciable loss of flexibility, as recorded by the bending modulus. Tensile strength followed a similar pattern.

It is also somewhat significant to note that adhering the EMDI treated paperboard to itself using Haloflex®208 resulted in a 13% increase in psi ring crush strength when compared with a single ply of EMDI treated paperboard as recorded in Table 1. It is normal for psi ring crush to be reduced by the process of adhering.

EXAMPLE 3

A series of tubes having varying wall thicknesses were manufactured with pretreated EMDI impregnated kraft coated Duro® as produced in Example 1. These tubes had an inner diameter of 2.700". The plies were laminated together with Haloflex®208 adhesive.

A control series of tubes having the same inside diameters and wall thicknesses was manufactured from multiply Durox®135 and E-200 adhesive. It was necessary to change the adhesive to E-200 because of difficulty in adhering the Durox®135 with the Haloflex®208. Standard beam strength tests were run comparing the EMDI treated tubes with the Durox®135 tubes and the results of these tests are shown in the graph in FIG. 1. From the graph, it can be seen that for any given wall thickness, the EMDI treated tubes exhibit almost twice the beam strength as the Durox®135 tubes. For example, a 0.150" wall Durox®135 tube has a beam strength of 220 pounds. The 0.150" wall EMDI treated tube has a beam strength of 440 pounds. In addition, it can be seen that the same beam strength would require a wall thickness of 0.290" for the Durox®135 tubes.

Figure 2:
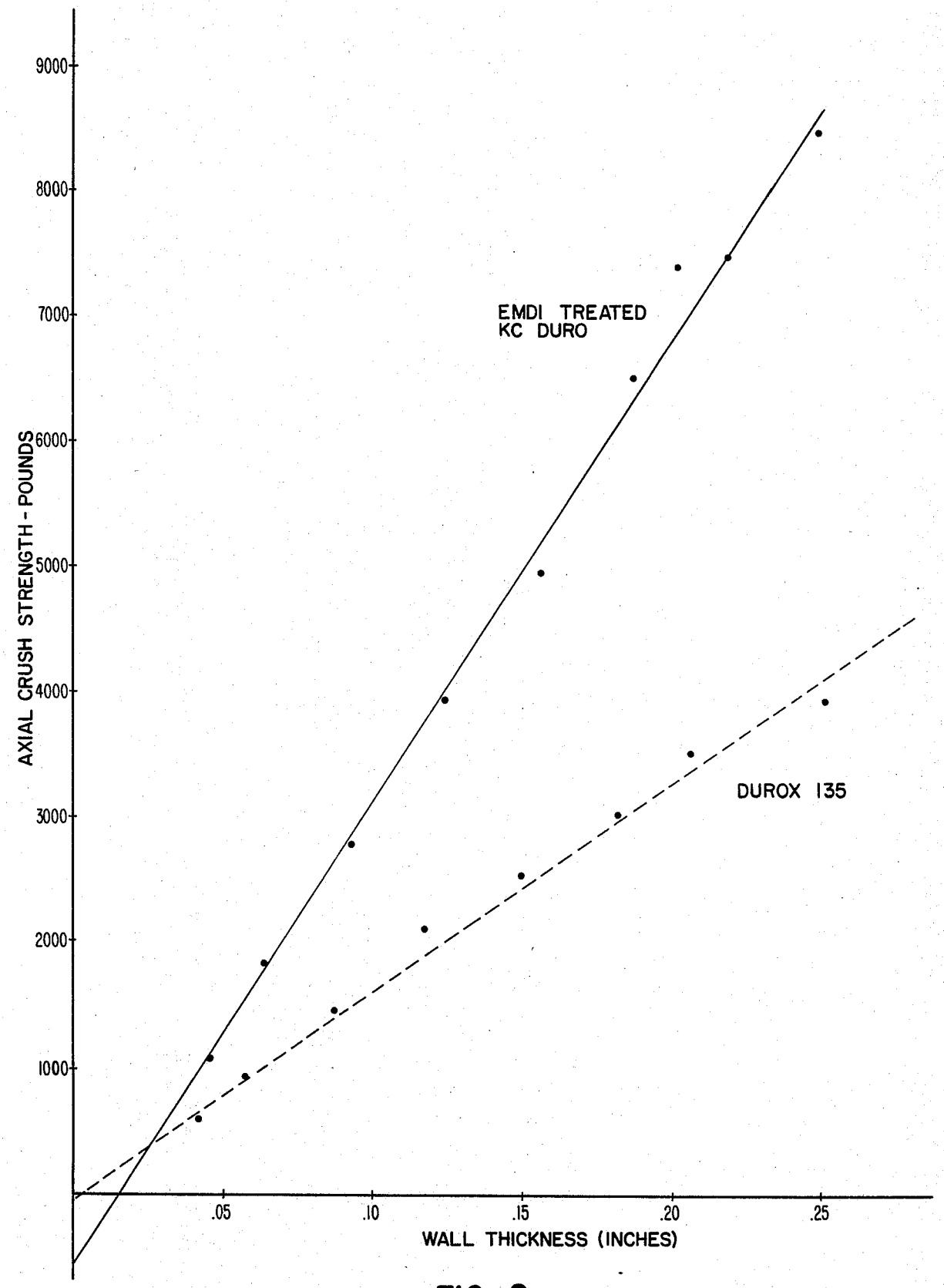
FIG. 2 is a graph of axial crush strength vs. wall thickness for tubes of EMDI-treated paper and untreated high strength paperboard.

FIG. 2 is a graph showing the results of a standard axial crush strength test performed on the two series of tubes. Once again, for any given wall thickness, the EMDI treated tubes exhibit almost twice the axial crush strength as the Durox®135 tubes. For example, the 0.150" wall Durox®135 tube gives an axial crush of 2500 pounds whereas the same EMDI tube gives an axial crush of 5000 pounds. A 5000 pound axial crush strength would require a wall thickness of 0.310" in a Durox®135 tube.

Figure 3:
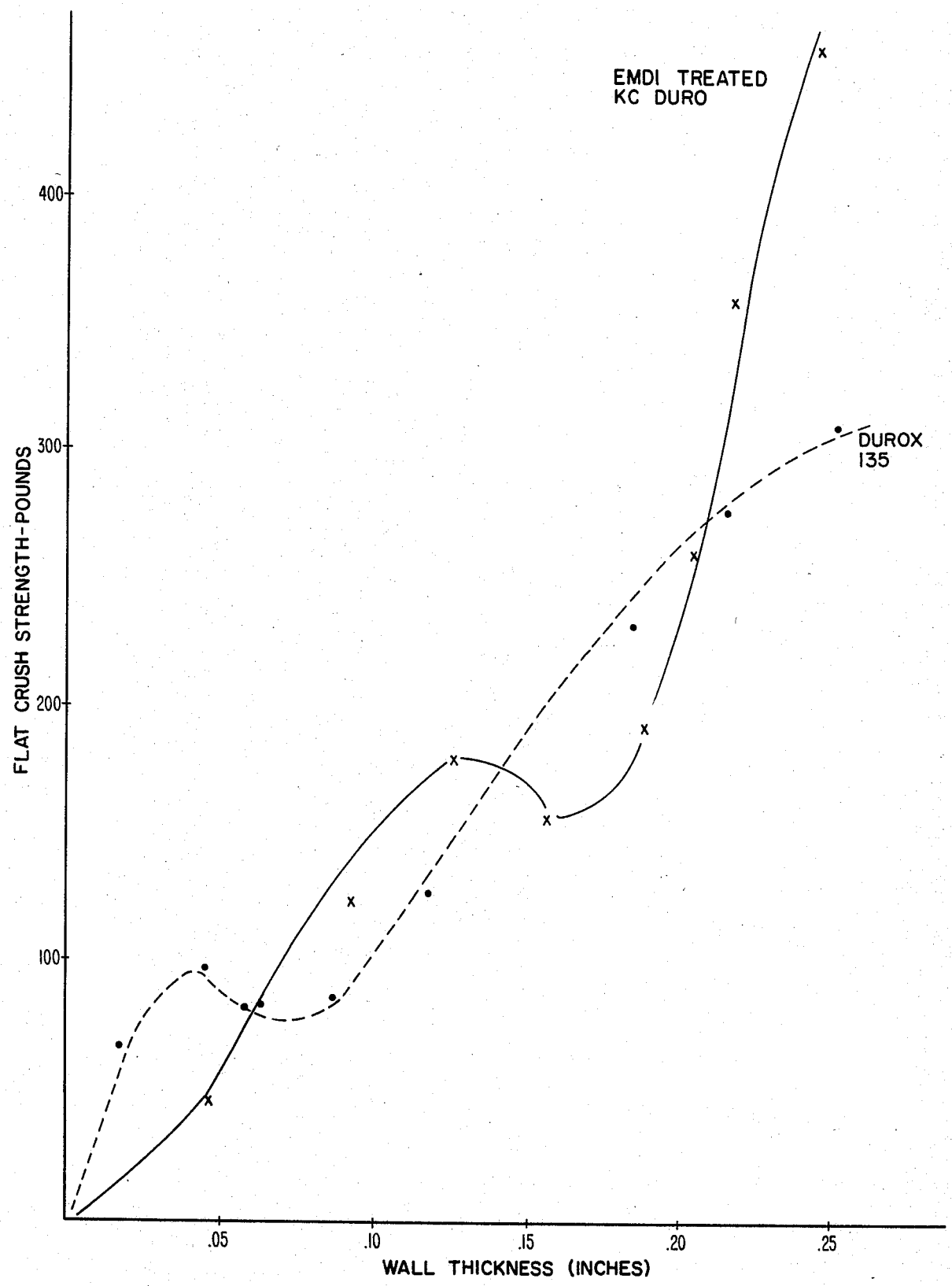
FIG. 3 is a graph of flat crush strength vs. wall thickness for tubes of EMDI-treated paper and untreated high strength paperboard.

The graph of FIG. 3 shows the results obtained by flat crushing 4" long specimens of the various Durox®135 and EMDI treated tubes. The results of this testing indicate that at certain wall thicknesses, the Durox®135 tubes possess more flat crush strength than the EMDI treated tubes. However, at relatively heavy wall thicknesses, the EMDI treated tubes appear to surpass the Durox®135 tubes.

Figure 4:
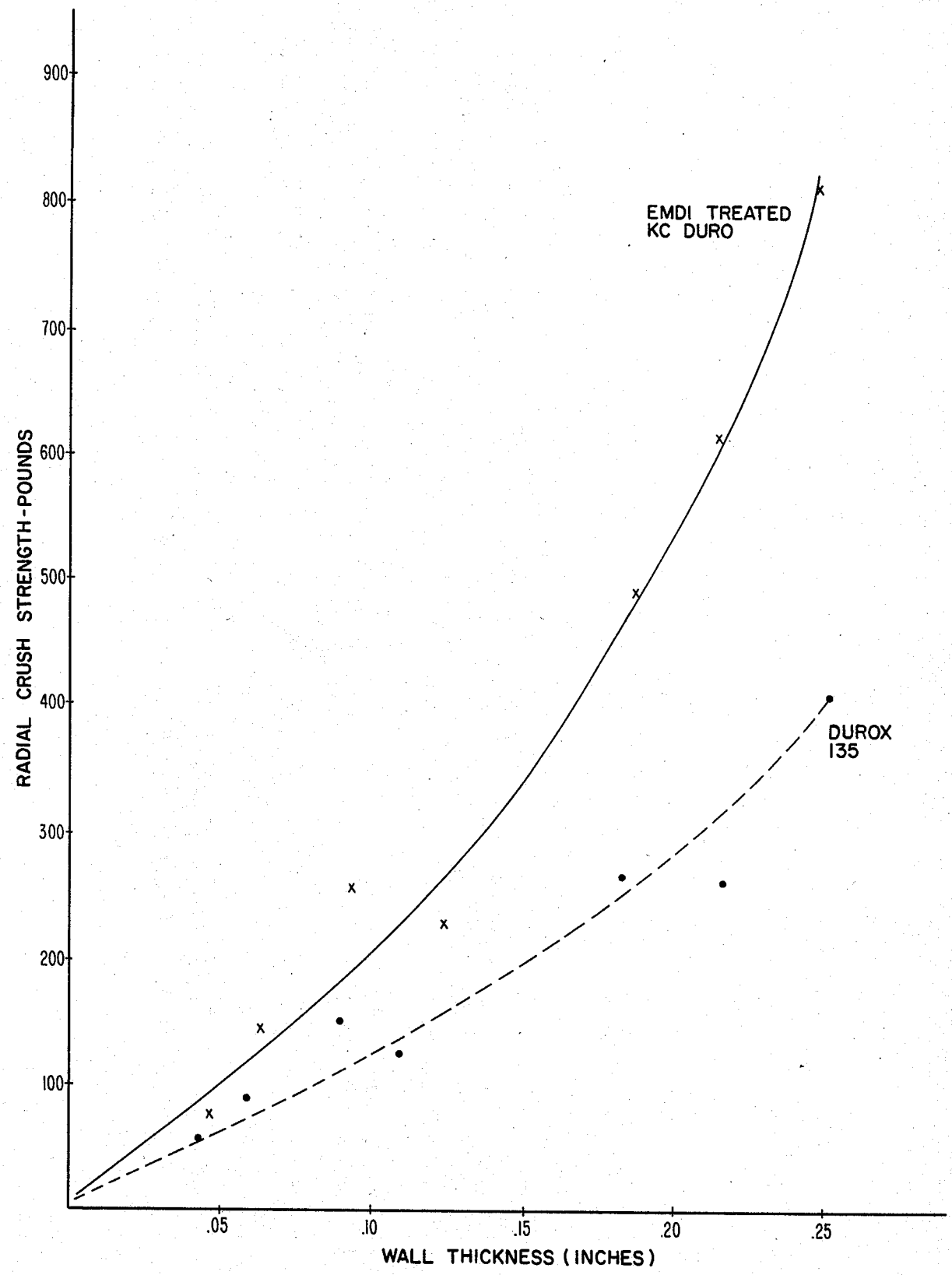
FIG. 4 is a graph of radial crush strength vs. wall thickness for tubes of EMDI-treated paper and untreated high strength paperboard.

The graph of FIG. 4 shows the results of radical crush tests performed on both sets of tubes. It can be seen that the EMDI treated tubes possess almost twice the radial crush strength as the Durox®135 tubes, at comparable wall thicknesses.

Figure 5:
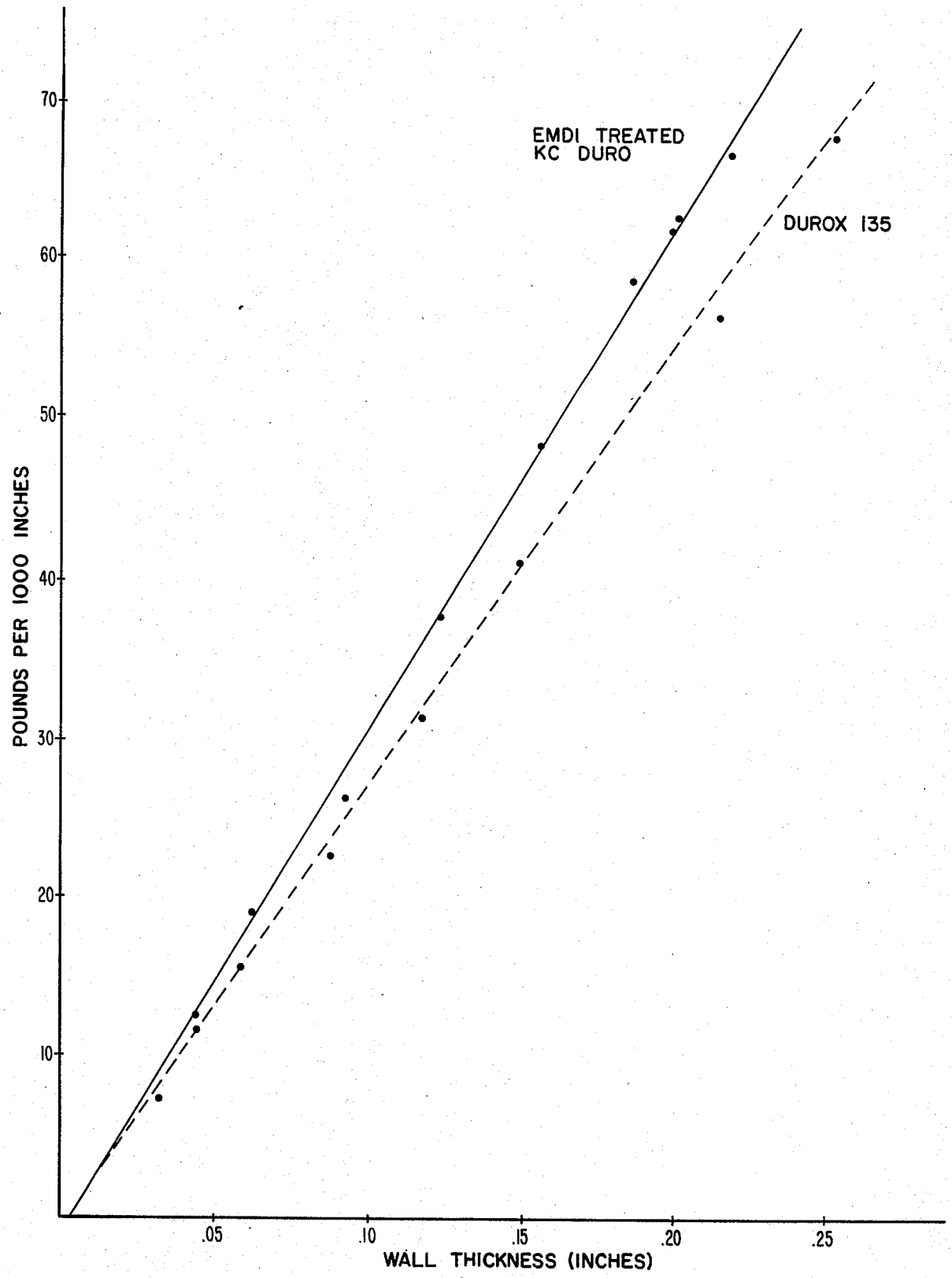
FIG. 5 is a graph of weight per 1000 inches vs. wall thickness for tubes of EMDI-treated paper and untreated high strength paperboard.

In addition to the discussed increase in strength, the EMDI tubes are also more economical than the Durox®135 tubes. As noted, wall thicknesses of Durox®135 tubes must be considerably greater than EMDI tubes to achieve comparable strength, generally on the order of two times greater. FIG. 5 is a graph of weight per 1000 inches of tube for various wall thicknesses of Durox®135 and EMDI tubes. From FIG. 5, it can be computed that a Durox®135 tube weighs about 80% more than an EMDI tube of equivalent strength with half the wall thickness.

Thus, although Durox®135 may currently cost less than EMDI-impregnated Duro® on a weight for weight basis, there will be far less material used in an EMDI tube of given strength than in a Durox®135 tube of the same strength. About 80% more pounds of Durox® tube will be necessary to achieve a given strength, and this difference in weight currently makes the EMDI-impregnated Duro® tube more economical by about 15%. Further savings may be realized in shipping costs of lighter tubes.

EXAMPLE 4

A multi-ply laminate spiral tube of 2.710" inside diameter was prepared in which all plies were Durox®135. This tube was compared for radial crush and flat crush with a similar tube in which 20% of the plies were replaced with EMDI-treated Duro®.

Flat crush was found to be reduced in the EMDI-containing tubes, but radial crush was increased by 11%.

EXAMPLE 5

Several 0.600" wall thickness, 3" I.D. Duro® papermill cores were treated by dipping the core ends into EMDI to a depth of six inches for two minutes. The tubes were allowed to cure for several days. Take-up of EMDI was determined to be 6% per linear inch of the treated area.

Treated and untreated cores were placed over an expandable chuck attached to a lathe, and the chuck was rotated with the core held stationary. This test simulated starting and stopping with several hundred pounds of paper wrapped around the core.

The chuck tended to tear out large chunks of paper from the untreated core during the first 20 seconds of operation, while no such tendency was noted with the treated cores. Moreover, deterioration of the wall at any time of operation was found to be about three times as great with the untreated core. The treated core was found to be relatively difficult to restrain from rotation indicating that in high speed operation, the treated core will probably start and stop with less drag. The treated cores also produced far less paper dust.

To further simulate plant conditions, the ends of treated and untreated cores were dipped in water for ten seconds prior to testing. The untreated cores swelled and delaminated on the chuck, with large chunks of paper torn off. The treated cores did not swell and appeared to repel water, although they did deteriorate faster on the chuck than dry, treated cores. There was no massive deterioration as with the untreated wet cores, however.

What is claimed is:

1. A tube of cone or paper-like material comprising a plurality of adhesive bonded layers of paper-like material, at least a portion of which is impregnated with a substantially non-blocking, cured, substantially anhydrous emulsifiable methylene diisocyanate.

2. A laminate of paper-like material comprising a plurality of adhesive-bonded layers of paper-like material, at least a portion of which is impregnated with a substantially non-blocking, cured, substantially anhydrous emulsifiable methylene diisocyanate.

3. A tube or cone according to claim 1, wherein said emulsifiable methylene diisocyanate comprises diphenyl methane-4,4'-diisocyanate.

4. A tube or cone according to claim 1, wherein said tube or cone includes at least one layer of a paper-like material which is not treated with emulsifiable methylene diisocyanate.

5. A tube or cone according to claim 1, wherein said portion which is impregnated with a cured emulsifiable methylene diisocyanate is in the region of the ends of the tube or cone.

6. A laminate according to claim 2, wherein said emulsifiable methylene diisocyanate comprises diphenyl methane-4,4'-diisocyanate.

7. A laminate according to claim 2, wherein said laminate comprises at least one layer of a paper-like material which is not impregnated with a cured emulsifiable methylene diisocyanate.

8. A laminate according to claim 2, wherein the portion of said laminate which is impregnated is in the region of the ends of the laminate.

* * * * *